US007808181B1

(12) United States Patent
Lammerant et al.

(10) Patent No.: US 7,808,181 B1
(45) Date of Patent: Oct. 5, 2010

(54) HIGH INTENSITY DISCHARGE LAMP WITH TERBIUM HALIDE FILL

(75) Inventors: Luc Stefaan Emmanuel Lammerant, Turnhout (BE); Antonius Hermanus Alfonsus Scharenborg, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 385 days.

(21) Appl. No.: 11/909,640

(22) PCT Filed: Mar. 17, 2006

(86) PCT No.: PCT/IB2006/050833

§ 371 (c)(1),
(2), (4) Date: Sep. 25, 2007

(87) PCT Pub. No.: WO2006/103588

PCT Pub. Date: Oct. 5, 2006

(30) Foreign Application Priority Data

Mar. 31, 2005 (EP) ..... 05102542

(51) Int. Cl.
*H01J 17/20* (2006.01)
*H01J 61/20* (2006.01)

(52) U.S. Cl. ..... 313/640; 313/567; 313/637

(58) Field of Classification Search ..... 313/567, 313/571, 637, 639, 640; 252/372
See application file for complete search history.

(56) References Cited

U.S. PATENT DOCUMENTS

| | | | | |
|---|---|---|---|---|
| 3,937,998 | A | 2/1976 | Verstegen et al. | |
| 5,965,984 | A * | 10/1999 | Horiuchi et al. | 313/637 |
| 6,362,571 | B1 * | 3/2002 | Suijker et al. | 313/637 |
| 6,841,938 | B2 * | 1/2005 | Hendricx et al. | 313/640 |
| 2003/0020408 | A1 * | 1/2003 | Higashi et al. | 313/637 |

FOREIGN PATENT DOCUMENTS

| | | | |
|---|---|---|---|
| EP | 386601 | A2 | 9/1990 |
| EP | 1428863 | A1 | 6/2004 |
| JP | 03095849 | | 4/1991 |
| JP | 2004139759 | A * | 5/2004 |
| JP | 2004158218 | | 6/2004 |

OTHER PUBLICATIONS

English Language translation of JP 2004-139759 A.*
English Language translation of JP 2005-158218 A.*

* cited by examiner

*Primary Examiner*—Peter J Macchiarolo
*Assistant Examiner*—Glenn Zimmerman

(57) ABSTRACT

The invention relates to a high intensity discharge lamp provided with a discharge vessel enclosing a discharge space comprising an ionizable filling including besides mercury a rare earth halide, which lamp emits during stable operation light with a color temperature Tc of at least 7000K. According to the invention the lamp of the type described in the opening paragraph is therefore characterized in that the rare earth of the rare earth halide comprises Tb or Tb and Dy.

12 Claims, 4 Drawing Sheets

HIGH INTENSITY DISCHARGE LAMP WITH TERBIUM HALIDE FILL

The invention relates to a high intensity discharge lamp provided with a discharge vessel enclosing a discharge space comprising an ionizable filling including besides mercury a rare earth halide, which lamp emits during stable operation light with a color temperature $T_c$ of at least 7000K.

Such lamps are known as medium source rare earth (MSR) lamps, for instance for stage light applications. In particular lamps are known comprising Gd as the metalhalide filling. The known lamp has a discharge vessel with a quartz wall. Drawback of the known lamp is that the emitted light is somewhat greenish, which tends to become worse with increasing values for $T_c$. A further drawback is that the quartz wall of the discharge vessel tends to be severely attacked by the filling, in particular by Gd. This intensifies with increasing wall load and is known as wall devitrification.

It is an object of the invention to provide a lamp of the type described in the opening paragraph, in which the drawbacks are counteracted.

According to the invention the lamp of the type described in the opening paragraph is therefore characterized in that the rare earth of the rare earth halide comprises Tb or Tb and Dy. In an alternative embodiment of the lamp according to the invention the filling also comprises Tm.

The invented lamp not only has the advantage that the drawbacks of the existing lamp are effectively counteracted, but additionally that the general color rendering index $R_a$ (also known as $R_{a8}$) is improved with 7 points or even more.

In particular advantageous is the lamp according to the invention in which the percentage Tb of the total of Tb and Dy together is within a range related to the wall load (wl) as defined by a polygon having vertices: wl (W/cm$^2$)% Tb

| | | | |
|---|---|---|---|
| 50 | → | 7 | → |
| 75 | → | 7 | → |
| 130 | | 80 | |
| 130 | | 100 | |
| 100 | | 100 | |
| 50 | | 30 | |

The wall load is taken over the wall surface directed to the discharge space. This is also described in the art as inner wall load.

In an advantageous embodiment of the lamp according to the invention the filling also comprises Cs halide. The Cs has a favorable effect on broadening the discharge and thus in stabilizing the discharge seizing on the electrodes.

In a further advantageous embodiment the discharge space also comprises Hf and thus promoting the stabilization of the lamp voltage Vla over life time when the lamp is operated on a magnetic ballast.

Nominal power rating of the lamp is to be understood in this description and claims to be the power for which the lamp has been designed to operate in steady state without dimming.

These and other aspects of the invention are apparent from and will be elucidated with reference to the embodiments described hereinafter.

Figure 4:
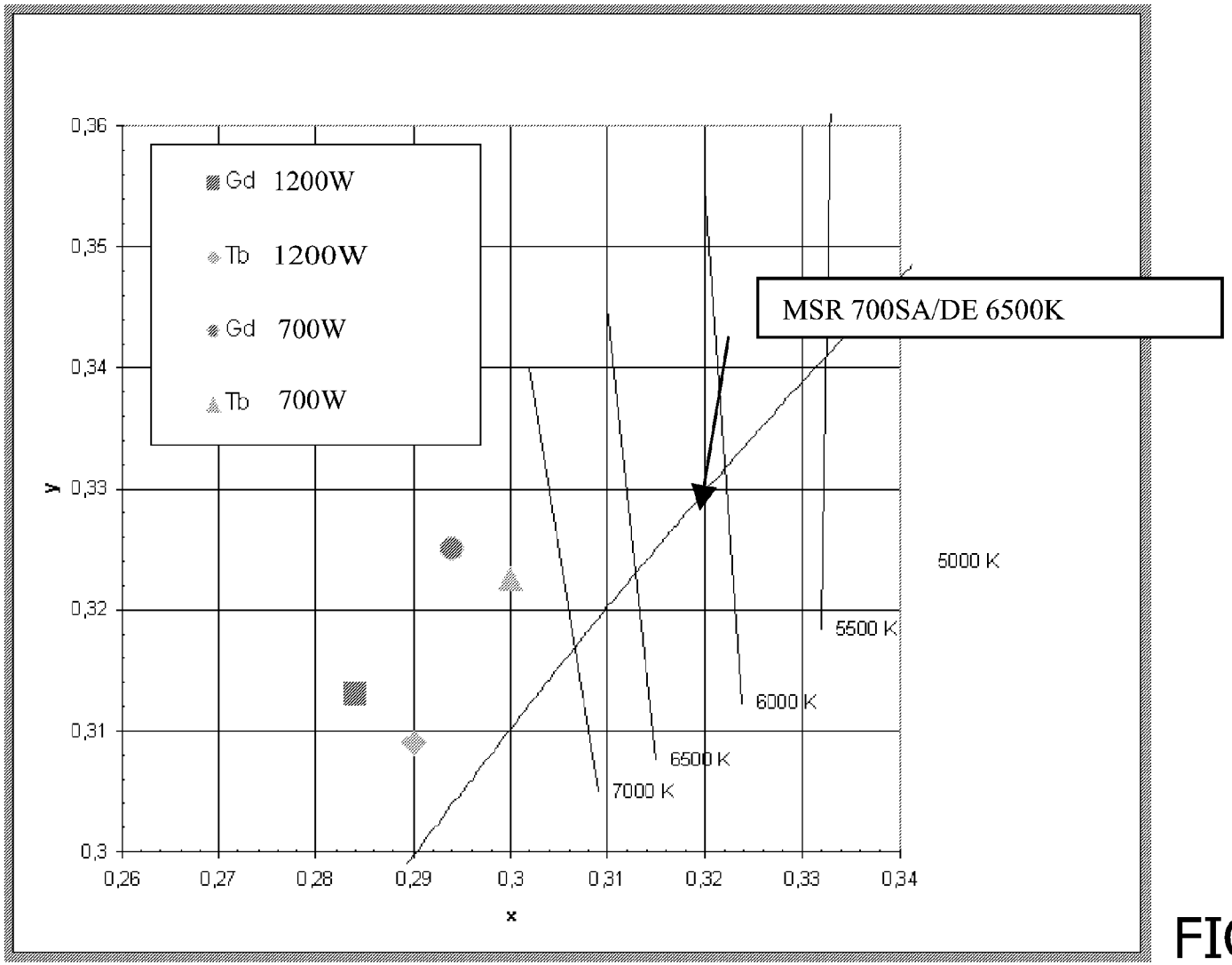
FIG. 4 shows color points of lamps.

Aim is to modify the current lamp type MSR 700SA/DE, make Philips with a color temperature of 6500K to a version with a $T_c$ of 7300K. A change in salt filling is required, also the shape of the H: discharge vessel will be changed. The wall load of both the known lamp and the lamp according to the invention is about 120 W/cm$^2$. The color point of the known lamp is shown in FIG. 4 and indicated MSR 700SA/DE 6500K.

Reason for said aim is the request for higher Tc as this leads to a higher "perceived brightness" which is especially important in the entertainment application, in particular stage light applications.

A known lamp, type HTI 700 W/D4/75, make Osram has been evaluated. Results are shown in Table I.

TABLE I

| Lamp | U lamp(V) | Imflux | lm/W | x | y | Tc | Ra8 |
|---|---|---|---|---|---|---|---|
| Philips MSR700SA/DE | 70 | 56000 | 80 | 0.314 | 0.326 | 6500 | 75 |
| Lamp of the invention | 70 | 51000 | 73 | 0.300 | 0.323 | 7300 | 74 |
| Osram HTI700W/D4/75-1 | 71 | 51760 | 74 | 0.290 | 0.319 | 8027 | 71 |
| Osram HTI700W/D4/75-2 | 66 | 50777 | 72 | 0.296 | 0.326 | 7521 | 73 |

For each lamp mentioned in Table I, there is given the lamp voltage U lamp in V, the luminous flux Imflux in Lm, the luminous efficacy in 1 m/W, the color point coordinates x and y, the color temperature $T_c$ in K and the general color rendering index for 8 colors $R_a$. The given values are for new lamps. An analysis has shown that the only rare earth used in HTI 700 W/D4/75 for salt is Gadolineum.

The lamp according the invention with a power rating of 700 W has the following main characteristic. The rare earth salt filling has been chosen to be TbBr3 only. Besides the filling comprises CsBr, Hg, $HgI_2$ and $HgBr_2$. The quantities are: Hg=57 mg; CsBr=0.48 mg; $TbBr_3$=0.72 mg; $HgI_2/HgBr_2$ (60/40)=1.25 mg. Main dimensions of the lamp are: outer diameter=18 mm; volume=1.62 cm$^3$; electrode distance=4 mm.

Figure 2:
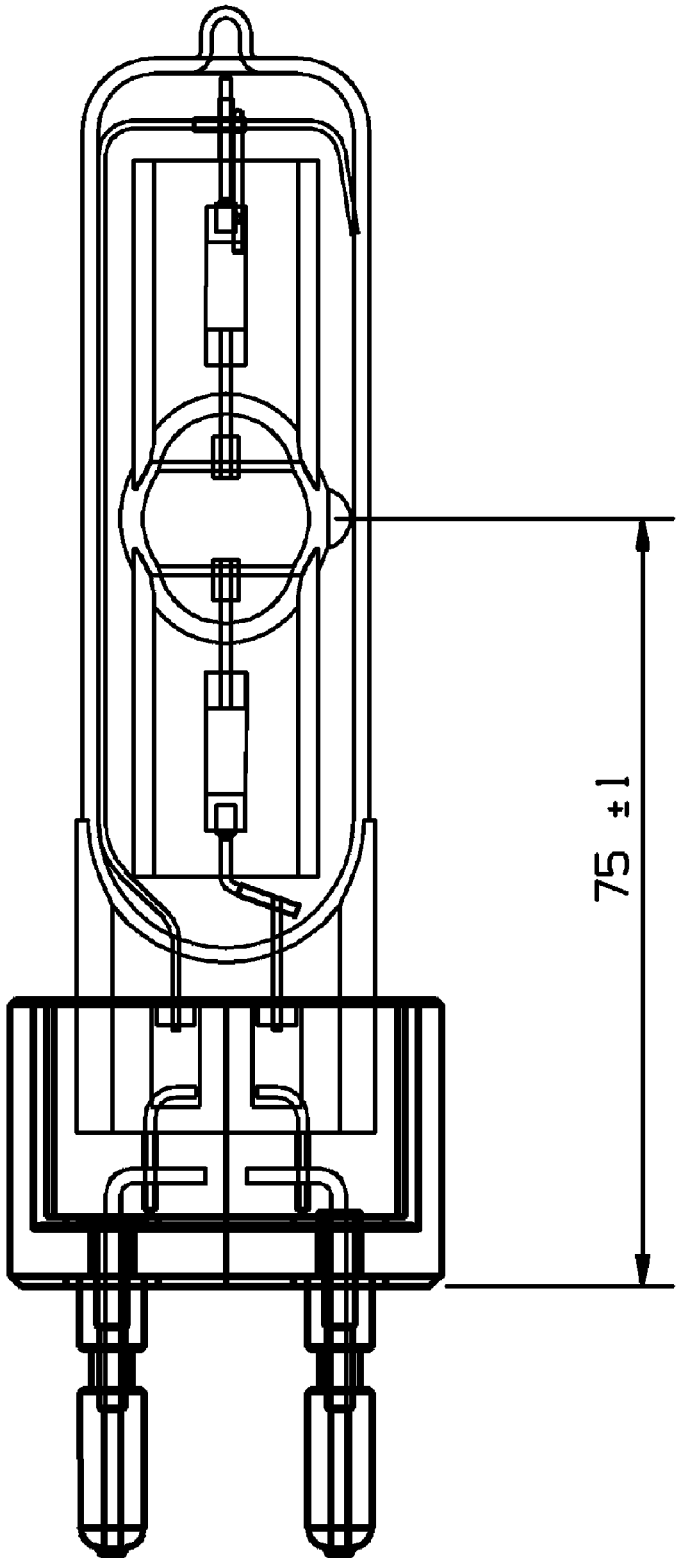
FIG. 2 shows a further embodiment.

Alternatively the discharge vessel is ellipsiodally shaped as shown in FIG. 2. Of the said type 3 lamps have been life-tested on a burning rack with electronic ballast. Also 3 lamps have been tested on a conventional ballasted burning rack.

The lamps that have been tested on electronic ballasts are measured at nominal power Pnom=700 W. The lamps that are tested on conventional ballasts are tested on Vsuppl. being 220 Volt. In Table II results are shown of a lamp according to the invention driven on a conventional ballast indicated <MSR 700SA/2 DE CuFe and of a lamp according to the invention driven on an electronic ballast indicated MSR700 SA/2 DE EVSA. The results are shown as mean value for three (3) lamps indicated by "gem". The shown results are: life time in hours, lamp current I_lmp in A, lamp voltage U_lmp in V, lamp voltage shift Delta Vla in V, lamp power P_lmp in W, lumen output in Lm, lumen maintenance in %, luminous efficacy in Lm/W, color point x and y indicated cc_x_cpd and cc_y_cpd respectively, color temperature Tc_cpb in K, shift in color temperature Delta Tc in K, color rendering index for 8 colors Ra8_cpd and the extend of wall attack in relative units.

TABLE II

| nr. | life time | l_lmp | U_lmp | Delta Vla | P_lmp | Lmflux | Maintenan | LM/W | cc_x_cpb | cc_y_cpb | Tc_cpb | Delta Tc | Ra8_cpb | Wall attack |
|---|---|---|---|---|---|---|---|---|---|---|---|---|---|---|
| MSR 700SA/2 DE CuFe | | | | | | | | | | | | | | |
| gem. | 0 | 11.43 | 69.4 | 0.0 | 699.9 | 50997 | 100.0 | 72.9 | 0.303 | 0.324 | 7092 | 0 | 72.1 | 0 |
| gem. | 100 | 11.13 | 73.4 | 4.1 | 748.4 | 52729 | 103.3 | 75.2 | 0.314 | 0.342 | 6366 | −726 | 81.6 | 3 |
| MSR 700SA/2 DE EVSA | | | | | | | | | | | | | | |
| gem. | 0 | 11.30 | 70.2 | 0.0 | 699.5 | 50848 | 100.0 | 72.7 | 0.300 | 0.323 | 7297 | 0 | 72.7 | 0 |
| gem. | 100 | 10.16 | 78.7 | 9.4 | 699.2 | 49553 | 98.1 | 70.9 | 0.306 | 0.335 | 6822 | −534 | 80.7 | 2 |
| gem. | 300 | 9.67 | 83.3 | 14.0 | 701.2 | 47831 | 94.7 | 68.2 | 0.301 | 0.327 | 7205 | −152 | 81.5 | 30 |
| gem. | 500 | 9.54 | 84.2 | 14.9 | 700.5 | 47401 | 0.0 | 67.7 | 0.300 | 0.326 | 7268 | −89 | 79.8 | 63 |

A 700 W lamp according to the invention (Salt Filling $TbBr_3$) is compared with a conventional lamp which comprises Gd as single rare earth metal. Both lamps have a wall load wl of 120 W/cm$^2$. Color points of the lamps are shown in FIG. 4 indicated Gd 700 W and Tb 700 W. The result is shown in Table III, together with the color temperature $T_c$ and color rendering index Ra.

TABLE III

| Rare earth of Salt Filling | Gd | Tb |
|---|---|---|
| $T_c$ | 7600 | 7300 |
| X | 0.294 | 0.300 |
| Y | 0.325 | 0.323 |
| Ra | 67 | 74 |

From the Table III it is clear that an improvement in Ra is realized of 7 points.

Figure 1:
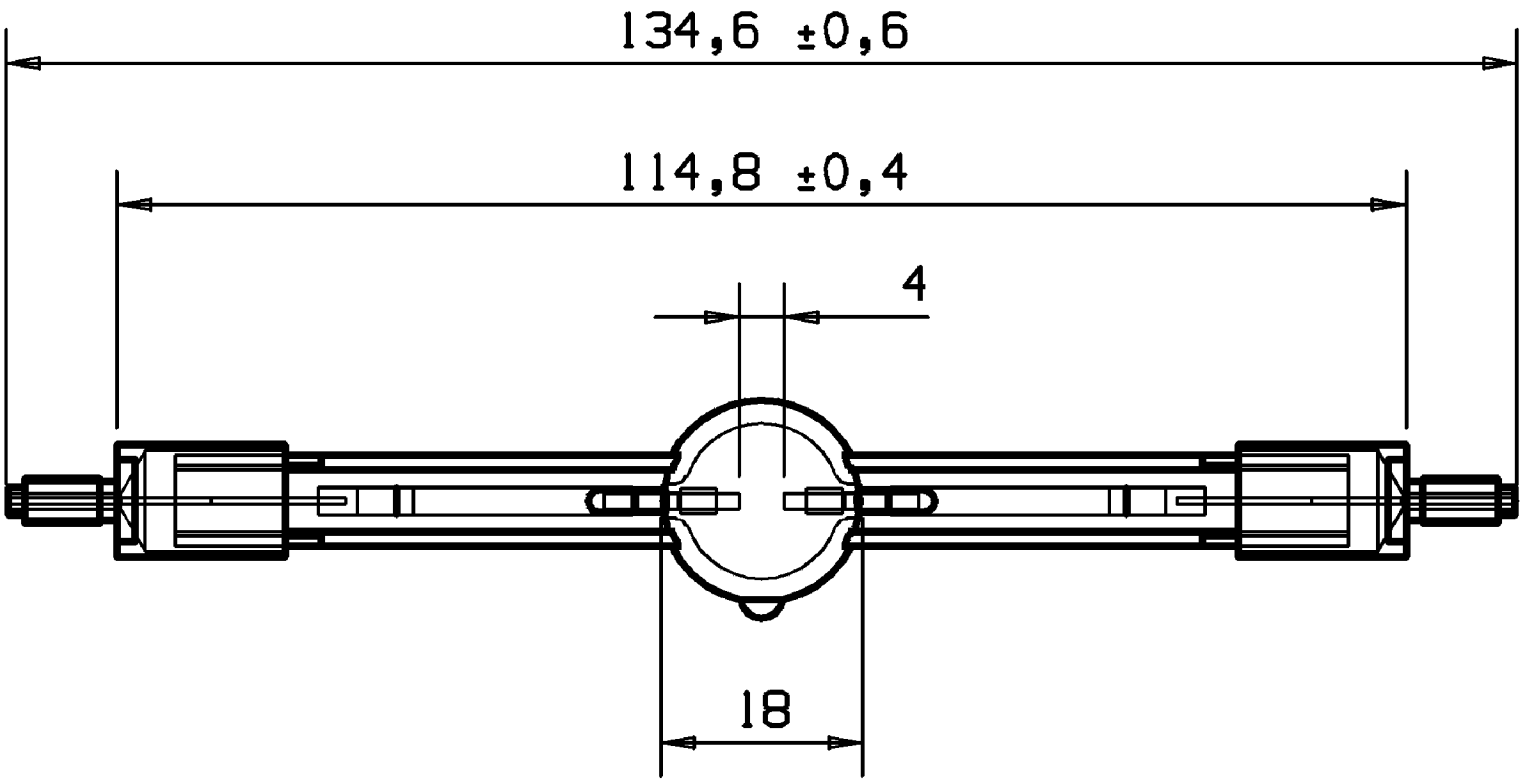
FIG. 1 shows a first embodiment of a lamp according to the invention.

In a further practical embodiment of a 700 W lamp according to the invention the lamp has a discharge vessel as shown in FIG. 1 with a volume of 1.7 cm$^3$. The lamp indicated as type 700SA/2 DE has a filling comprising TbBr3, CsBr and the usual HgI2, HgBr2 and Hg.

Besides the above described embodiments there is developed a 1200 W lamp according to the invention. The possibilities of the use of Terbium in the filling were explored in order to obtain a lamp with a high color temperature combined with a good light quality.

The comparison in table IV shows the differences between a lamp with a rare earth filling of pure Gd halide and a lamp with a rare earth filling of pure Tb halide (test M1709). With the Gd halide filling a slightly higher color temperature can be reached but the lamp has a greener color impression (higher y-coordinate), a lower color rendering index (−9) and has a faster development of the devitrification. The color points of the lamps are shown in FIG. 4 as Gd 1200 W and Tb 1200 W.

TABLE IV

Influence of the type of salt on the lamp performance.

| Rare earth of Salt Filling | Gd | Tb |
|---|---|---|
| $T_c$ | 8600 | 8300 |
| X | 0.284 | 0.290 |
| Y | 0.313 | 0.309 |
| Ra | 73 | 82 |

The lamp with Tb showed after 300 hours of operation a wall attack measured in arbitrary units which is 5 times less than in the case of the conventional lamp comprising Gd.

In the developed lamp the fillings is chosen:

a ratio Tb versus Dy to get the right color temperature;

an increase in the salt content in order to increase the color rendering index; and introduction of Hf as metal in order to stabilize the lamp voltage Vla over life time when operated on a magnetic ballast.

The filling thus defined is:

0.9 mg $TbBr_3$/$DyBr_3$ CsBr (salt mass ratio 58.33/11.66/30)

1.2 mg HgI2/HgBr2 (80/20)

1.08 mg HgBr2

0.18 mg Hf 65 mg Hg

Figure 3:
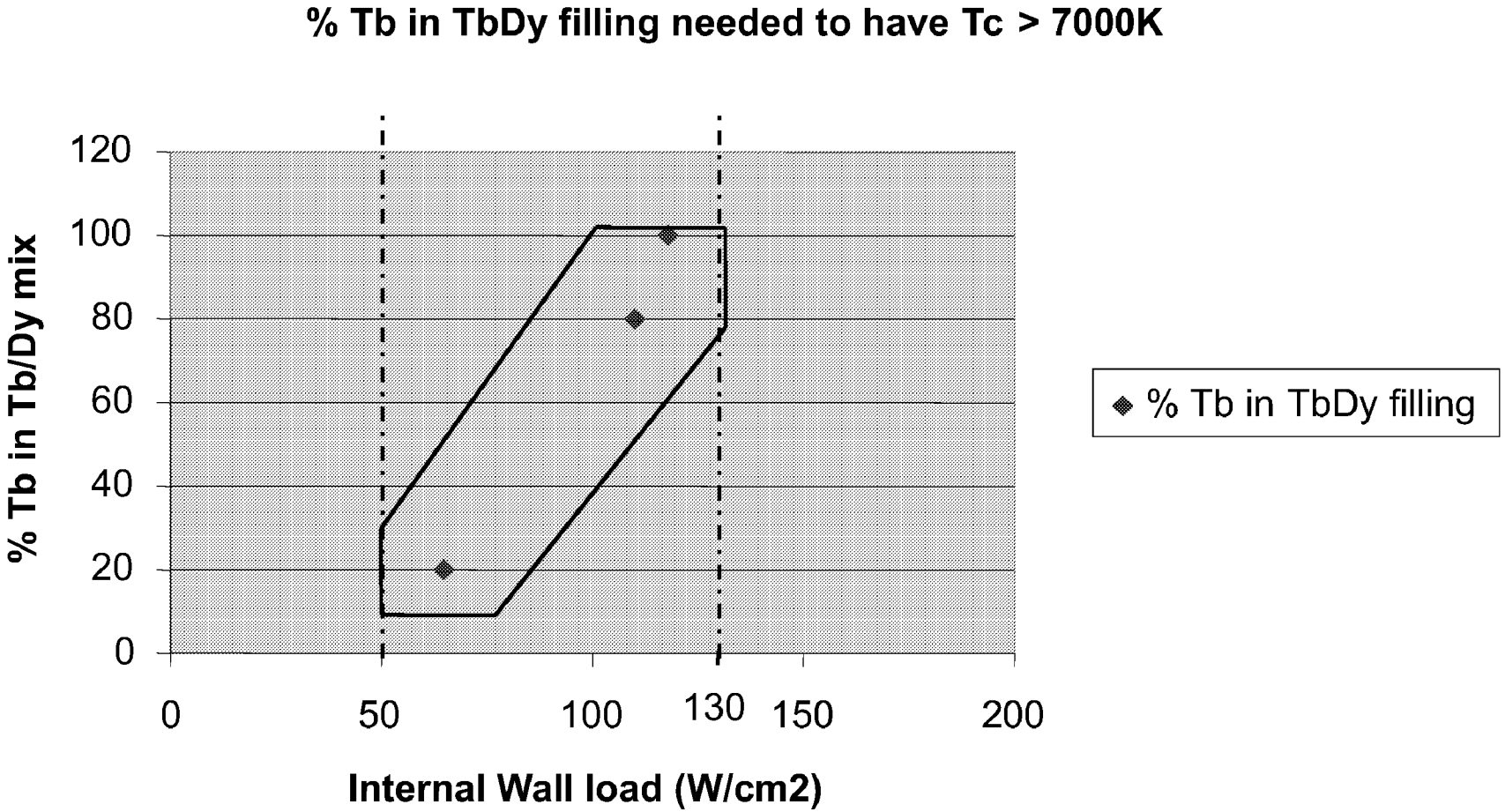
FIG. 3 shows the range in which the percentage Tb of the total of Tb and Dy together is in relation to the wall load (wl)

The lamp has a discharge vessel as shown in FIG. 1 with a volume of 3 cm$^3$. In a further practical embodiment of the lamp according to the invention the lamp has a nominal power rating of 1200 W. The filling of the discharge vessel comprised besides $TbBr_3$ also $DyBr_3$ in a mass ratio of 20/80. The addition of Dy is done to arrive at a wanted value of the color temperature Tc of about 7200K. The wall load wl of the discharge vessel is about 110 W/cm$^2$, which is inside the area shown in FIG. 3.

In a further practical embodiment of the lamp according to the invention the lamp, which has a construction as shown in FIG. 2 has a nominal power rating of 700 W and a relatively lower wall load of 65 W/cm$^2$. The filling of the discharge vessel comprised besides $TbBr_3$ also $DyBr_3$ in a mass ratio of 20/80. The addition of Dy halide is done to arrive at a wanted value of the color temperature $T_c$ of about 7200K. With different mixtures of Dy halide and Tb halide a whole range of $T_c$'s is obtainable, with the before mentioned advantages compared to Gd halide containing filling. In Table V the relation is shown between the value for $T_c$ and the percentage of Tb (Terbium) in the Tb_, Dy salt mix in a 700 W lamp according to FIG. 2 having a relatively low wall loading of 65 W/cm$^2$

TABLE V

| % Tb of Tb and Dy together | $T_c$ (K) |
|---|---|
| 0 | 6390 |
| 20.4 | 7230 |
| 41.2 | 7620 |
| 59.3 | 7920 |
| 75 | 8370 |
| 100 | 9480 |

The invention claimed is:

1. A high intensity discharge lamp provided with a discharge vessel enclosing a discharge space containing an ionizable filling that includes mercury and a rare earth halide, which lamp emits during stable operation light with a color temperature $T_c$ of at least 7000K, wherein: the rare earth element of the rare earth halide includes Terbium (Tb) and Dysprosium (Dy), having a wall load, and a mass percentage (% Tb) of the Tb of a total amount of the Tb and Dy together is within a range related to the wall load (wl) as defined by a polygon having vertices:

| wl ($W/cm^2$) | % Tb |
|---|---|
| 50 | 7 |
| 75 | 7 |
| 130 | 80 |
| 130 | 100 |
| 100 | 100 |
| 50 | 30. |

2. The lamp of claim 1, wherein the rare earth halide of the filling includes Thulium (Tm).

3. The lamp of claim 1, wherein the filling includes Hafnium (Hf).

4. The lamp of claim 2, wherein the filling includes Hf.

5. The lamp of claim 1, wherein the filling includes Cesium (Cs).

6. The lamp of claim 2, wherein the filling includes Cs.

7. The lamp of claim 3, wherein the filling includes Cs.

8. The lamp of claim 4, wherein the filling includes Cs.

9. The lamp of claim 1, wherein the lamp is configured to operate at a nominal voltage of at least 700 watts.

10. The lamp of claim 9, wherein the wall load is at least 100 $W/cm^2$.

11. The lamp of claim 9, wherein a mass ratio of Tb to Dy is such that the color temperature is approximately 7200K.

12. The lamp of claim 1, wherein a mass ratio of Tb to Dy is in the order of 4:1.

* * * * *